US009427649B2

(12) United States Patent
Teevens et al.

(10) Patent No.: US 9,427,649 B2
(45) Date of Patent: Aug. 30, 2016

(54) MOBILE DEVICE WHICH SIMULATES PLAYER MOTION

(71) Applicants: Eugene F. Teevens, Hanover, NH (US); Quinn Reid Connell, Pleasant Hill, OR (US); Noah James Glennon, Portsmouth, NH (US); Elliot James Kastner, Hanover, NH (US); Andrew William Smist, Cambridge, MA (US)

(72) Inventors: Eugene F. Teevens, Hanover, NH (US); Quinn Reid Connell, Pleasant Hill, OR (US); Noah James Glennon, Portsmouth, NH (US); Elliot James Kastner, Hanover, NH (US); Andrew William Smist, Cambridge, MA (US)

(73) Assignee: MOBILE VIRTUAL PLAYER LLC, Lebanon, NH (US)

( * ) Notice: Subject to any disclaimer, the term of this patent is extended or adjusted under 35 U.S.C. 154(b) by 0 days.

(21) Appl. No.: 14/582,264

(22) Filed: Dec. 24, 2014

(65) Prior Publication Data

US 2015/0182834 A1 Jul. 2, 2015

Related U.S. Application Data

(60) Provisional application No. 61/920,801, filed on Dec. 26, 2013.

(51) Int. Cl.
*A63B 69/34* (2006.01)
*A63B 71/00* (2006.01)

(52) U.S. Cl.
CPC ..... *A63B 69/345* (2013.01); *A63B 2071/009* (2013.01); *A63B 2071/0063* (2013.01); *A63B 2225/305* (2013.01); *A63B 2243/007* (2013.01); *A63B 2243/0066* (2013.01)

(58) Field of Classification Search
CPC ..... A63B 69/24; A63B 69/34; A63B 69/345
USPC ..... 473/441, 445, 444, 438; 180/7.1, 21; 280/5.515, 512, 47.22, 787
See application file for complete search history.

(56) References Cited

U.S. PATENT DOCUMENTS

| | | | | |
|---|---|---|---|---|
| 314,549 | A | 3/1885 | Tucker | |
| 1,204,017 | A | 11/1916 | Hinkey | |
| 1,544,110 | A | 6/1925 | Stall | |
| 1,611,194 | A | 12/1926 | Henderson | |
| 1,622,691 | A | 3/1927 | Warner | |
| 1,663,659 | A | 3/1928 | Hart et al. | |
| 1,708,638 | A | 4/1929 | Smith | |
| 1,817,364 | A | 8/1931 | Goldsmith | |
| 1,906,693 | A | 5/1933 | Loughlin | |
| 2,037,508 | A * | 4/1936 | Gilman | A63B 69/345 473/444 |
| 2,466,954 | A | 4/1949 | King | |
| 3,114,549 | A | 12/1963 | Hooker | |
| 3,281,148 | A | 10/1966 | Cummins | |
| 3,337,217 | A | 8/1967 | Cummins | |

(Continued)

*Primary Examiner* — Gene Kim
*Assistant Examiner* — Rayshun Peng
(74) *Attorney, Agent, or Firm* — McNees Wallace & Nurick LLC

(57) ABSTRACT

A mobile device which simulates player motion, the device includes a ball drive, omni-directional members, at least one motor, a controller and pads. The ball drive provides rolling motion to the device. The omni-directional members are positioned proximate to and in engagement with the ball drive. The at least one motor is connected to the omni-directional members, the at least one motor providing the motive force to drive the omni-directional members and the ball drive. The controller controls the motor. The pads are positioned on the device. The device accurately mimics the unpredictable motion of a live player to provide a safe alternative to live play to increase player safety and decrease the incidence of injuries during practice sessions.

21 Claims, 5 Drawing Sheets

(56) References Cited

U.S. PATENT DOCUMENTS

| | | | | |
|---|---|---|---|---|
| 3,464,696 | A | 9/1969 | Hooker | |
| 3,556,523 | A | 1/1971 | Hooker | |
| 3,637,210 | A | 1/1972 | Brantley | |
| 3,659,848 | A | 5/1972 | DePew | |
| 4,861,053 | A * | 8/1989 | Yeomans, Jr. | B62K 17/00 180/21 |
| 5,110,124 | A | 5/1992 | Micco | |
| 5,280,905 | A | 1/1994 | Micco | |
| 5,335,906 | A | 8/1994 | Delker | |
| 7,794,337 | B2 | 9/2010 | Gamboa | |
| 8,028,775 | B2 * | 10/2011 | Orenbuch | B60B 33/08 180/252 |
| 8,070,561 | B2 * | 12/2011 | Liffers | A47L 11/16 451/350 |
| 8,459,383 | B1 * | 6/2013 | Burget | B60B 19/003 180/7.1 |
| 8,499,864 | B2 * | 8/2013 | Takenaka | B60B 19/003 180/10 |
| 8,790,198 | B1 | 7/2014 | Russell | |
| 8,808,115 | B2 | 8/2014 | De Troia | |
| 2010/0243342 | A1 * | 9/2010 | Wu | B60B 19/14 180/7.1 |
| 2012/0283047 | A1 | 11/2012 | De Troia | |
| 2013/0053189 | A1 * | 2/2013 | Peterson | A63B 69/345 473/445 |

* cited by examiner

MOBILE DEVICE WHICH SIMULATES PLAYER MOTION

FIELD OF THE INVENTION

The present invention is directed to a dynamic drive system and mobile device which simulates player motion in a realistic manner. In particular, the invention is directed to a mobile device which allows for sports practice, such as tackling, without the injuries associated with player-to-player contact.

BACKGROUND OF THE INVENTION

Many sports, including, but not limited to, football, soccer and rugby can pose serious health risks to the players. For example, a major concern facing football players today is the risk of concussive head injuries, which can lead to a variety of dangerous medical conditions. In order to reduce the occurrence of these types of injuries, teams are limiting contact during practices. In place of tackling each other during practice, most teams now use tackling drills which simplify tackling and break it into multiple steps which can be safely practiced. Limiting contact has been successful at reducing injuries during practice, but it has left no way to for players to practice tackling in a realistic game-relevant scenario. This is because current drills focus on pursuing a player and not finishing the tackle to the ground, or using a padded target, known as a tackling dummy, instead of a live player. Tackling dummies are used by almost all football teams but do not simulate a realistic tackle because they are static objects whereas an opposing player moves dynamically. There are some products on the market today that attempt to mobilize the tackling dummy; however, none of them accurately simulate the motion of a live player.

Although various methods to provide for increased safety have been attempted, these devices have not effectively protected athletes while simulating the motion of a live player. Making tackling safer through tackling suits or a padded practice area does not eliminate player-to-player contact and therefore does not adequately reduce injury risks. Hit shields (small, player-held pads) do not allow players to finish a tackle to the ground. Designing new drills using existing static dummies is not effective at producing unpredictable motion and does not create a game-like scenario. Shoulder tag, or "thud pace," is not viable because, like hit shields, it neither eliminates player-to-player contact or creates a realistic game-like scenario.

In order to prevent injuries while allowing players to practice various movements (including, but not limited to, tackling, shooting and passing) without person-to-person contact or interaction, sports teams (including but not limited to, football, soccer and rugby teams) are in need of a dynamic and mobile device which replicates or simulates player motion as realistically as possible. With respect to football, an effective solution will allow teams to safely integrate the initiation, execution and finish of the movement, i.e., a tackle.

It would, therefore, be beneficial to provide a device or system which safely allows players to practice proper form in a game-relevant scenario. It would also be beneficial to provide a device or system which is a safe alternative to live play and which increases player safety and reduces the incidence of injuries while at the same time reinforcing proper form.

SUMMARY OF THE INVENTION

An embodiment of the invention is directed to a device and/or drive system which safely allows players to practice proper tackling form in a game-relevant scenario.

An embodiment of the invention is directed to a device and/or drive system which provides a safe alternative to live play and which increases player safety and reduces the incidence of injuries while at the same time reinforcing proper tackling form.

An embodiment of the invention is directed to a device and/or drive system which allows teams to safely integrate the pursuit, breakdown and finish of a tackle.

An embodiment of the invention is directed to a device and/or drive system which reflects the unpredictable motion of a live player.

An embodiment of the invention is directed to a device and/or drive system which is safe to tackle.

An embodiment of the invention is directed to a device and/or drive system which simulates realistic tackling.

An embodiment of the invention is directed to a device and/or drive system which works on a turf field in all playable weather conditions.

An embodiment of the invention is directed to a device and/or drive system which can be stored easily between practices and which is able to be reset quickly between each repetition of a drill.

An embodiment of the invention is directed to a device and/or drive system which is controlled using a wireless control system, allowing for device to be controlled remotely to facilitate maximum mobility and precision.

An embodiment is directed to a mobile device which simulates player motion. The device includes a ball drive, omni-directional members, at least one motor, a controller and pads. The ball drive provides rolling motion to the device. The omni-directional members are positioned proximate to and in engagement with the ball drive. The at least one motor is connected to at least one of the omni-directional members, the at least one motor providing the motive force to drive the at least one omni-directional members and the ball drive. The controller controls the motor. The pads are positioned on the device. The device accurately mimics the unpredictable motion of a live player to provide a safe alternative to live play to increase player safety and decrease the incidence of injuries during practice sessions.

An embodiment is directed to a self-righting mobile device which simulates player motion. The device includes a ball drive for providing rolling motion to the device. Omni-directional wheels are positioned proximate to and in engagement with the ball drive. At least one motor is connected to at least one of the omni-directional wheels. The at least one motor provides the motive force to drive the at least one omni-directional wheel and the ball drive. A controller controls the at least one motor. Pads are positioned on the device. The pads include high density foam around a base of the mobile device, the high density providing structure to self-right the mobile device. The pads also include low density foam in an upper portion of the mobile device used as the primary impact area. The device accurately mimics the unpredictable motion of a live player to provide a safe alternative to live play to increase player safety and decrease the incidence of injuries during practice sessions.

An embodiment is directed to a mobile device which simulates player motion which includes a ball drive to provide rolling motion to the device. Omni-directional wheels are positioned proximate to and in engagement with the ball drive. The omni-wheels engage the ball drive to power the ball drive in any direction, allowing for the mobile device to have a complete range of motion and allowing the mobile device to quickly change directions. At least one motor is connected to at least one of the omni-directional wheels, the at least one motor providing the motive force to drive the at least one omni-directional wheel and the ball drive. Adjustable casters cooperate with the ball drive. The casters apply pressure to the ball to keep the omni-wheels in contact with the ball drive at all times despite any eccentricity in the shape of the ball drive. A controller controls the at least one motor. Pads are positioned on the device. The device accurately mimics the unpredictable motion of a live player to provide a safe alternative to live play to increase player safety and decrease the incidence of injuries during practice sessions.

An embodiment is directed to a drive system for a mobile device. The drive system includes a ball drive for providing rolling motion to the device. Omni-directional members are positioned proximate to and in engagement with the ball drive. At least one motor is connected to at least one of the omni-directional members, wherein the at least one motor provides the motive force to drive the at least one omni-directional member and the ball drive. Adjustable casters cooperate with the ball drive to apply pressure to the ball to keep the omni-wheels in contact with the ball drive at all times despite any eccentricity in the shape of the ball drive. A controller is provided to control the at least one motor.

An embodiment is directed to a remote controlled mobile device which simulates player motion. The device includes a drive, at least one motor, a wireless controller and pads. The drive provides rolling motion to the device. The at least one motor is provides the motive force to power the drive. The wireless controller controls the motor. The pads are positioned on the device. The device accurately mimics the unpredictable motion of a live player to provide a safe alternative to live play to increase player safety and decrease the incidence of injuries during practice sessions.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
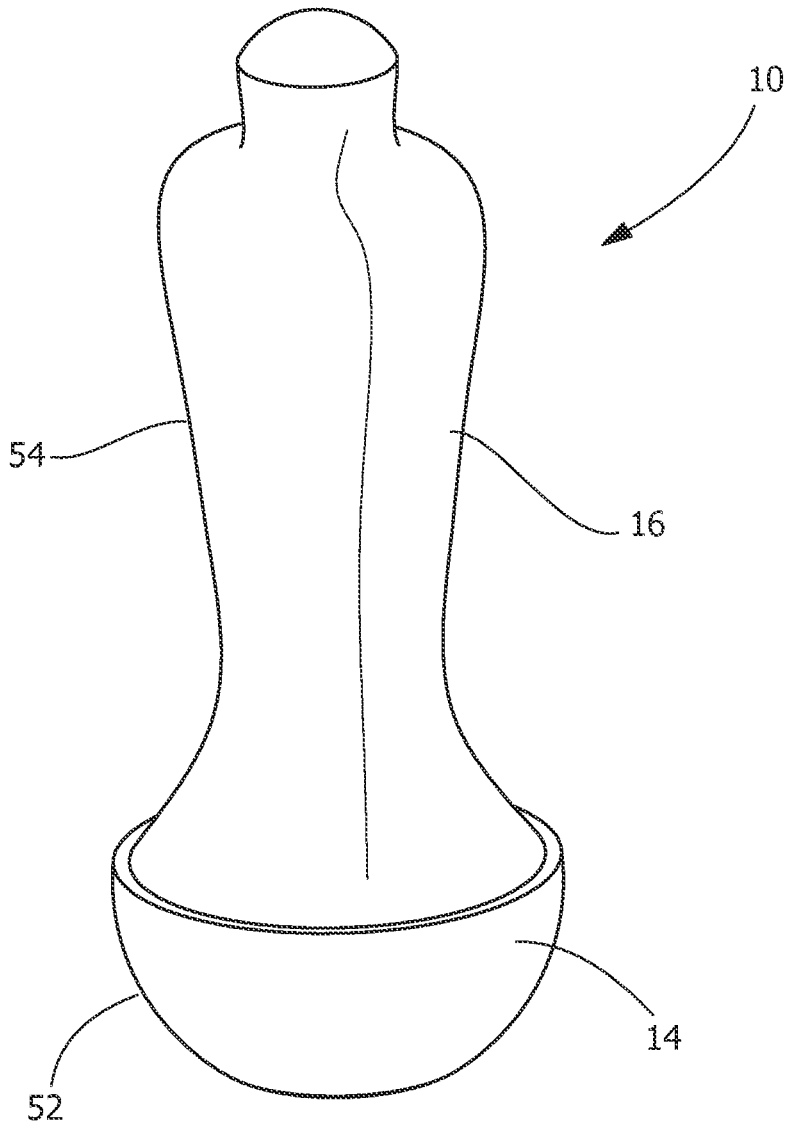
FIG. 1 is a perspective view of an illustrative embodiment of a mobile device which simulates player motion according to the present invention.
Figure 2:
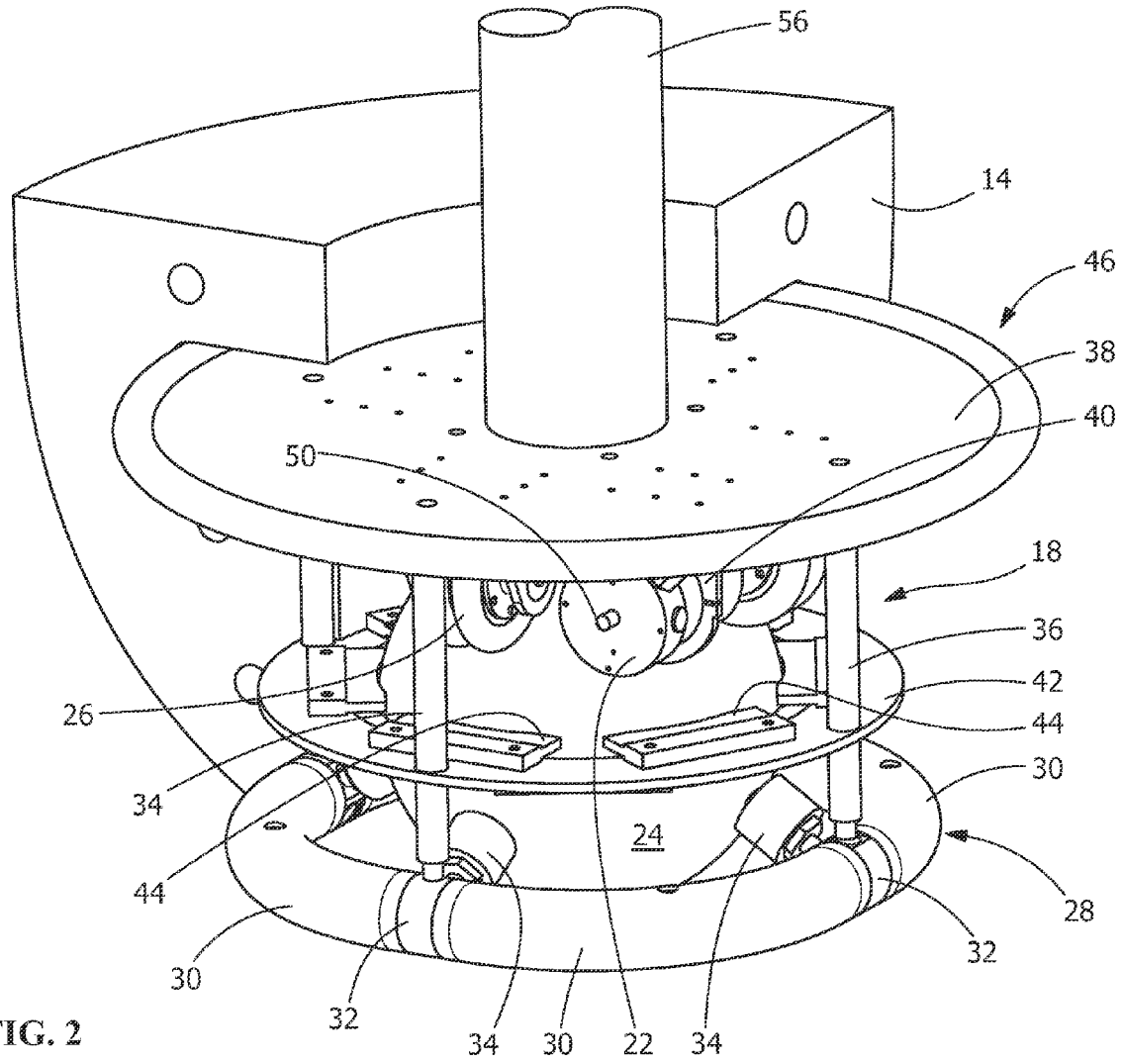
FIG. 2 is a top, side perspective view of a lower portion of the mobile device of FIG. 1 with portions of the padding removed.
Figure 3:
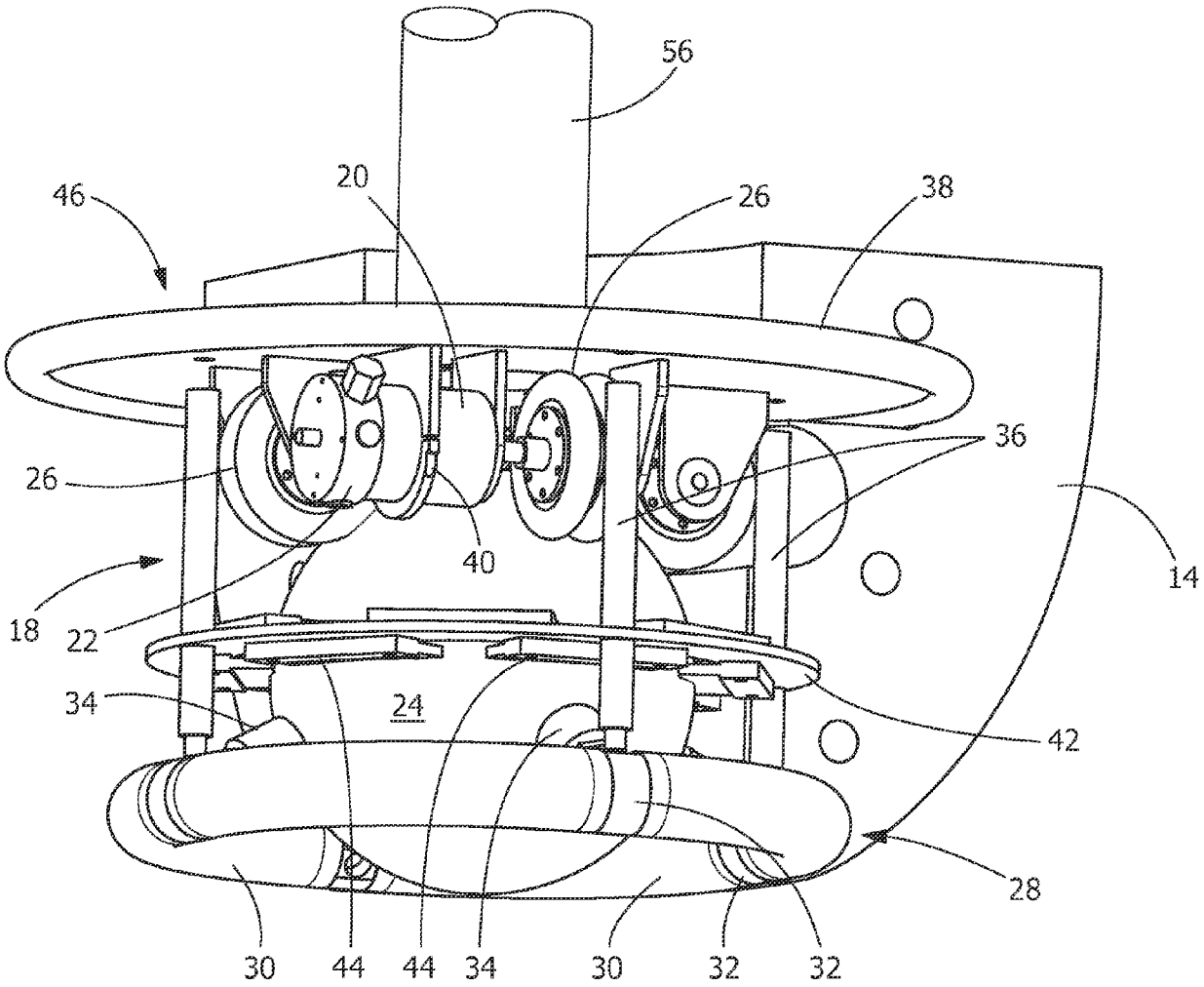
FIG. 3 is a bottom, side perspective view of the lower portion of the mobile device shown in FIG. 2.
Figure 4:
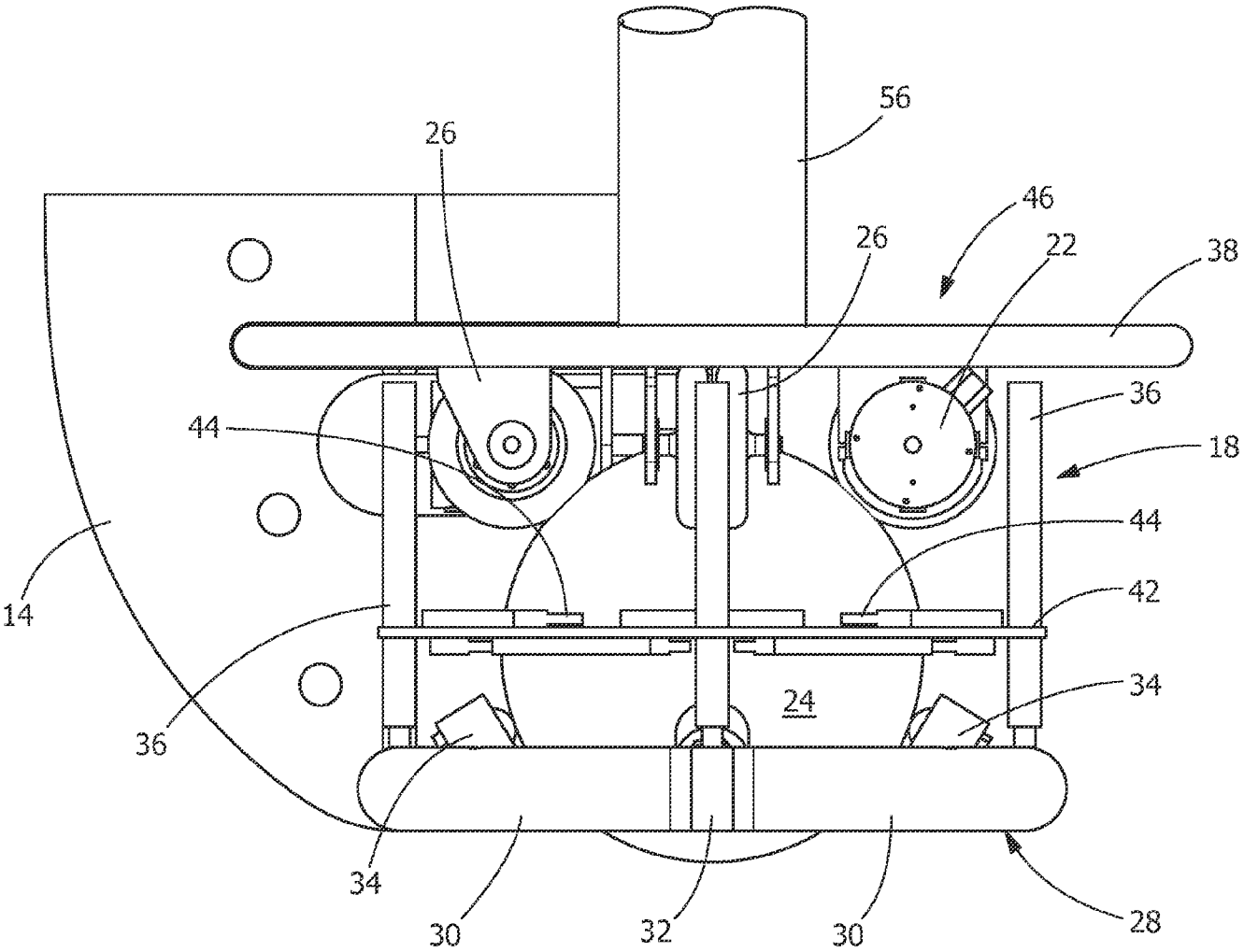
FIG. 4 is side view of the lower portion of the mobile device shown in FIG. 2.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the illustrative embodiments. Accordingly, the invention expressly should not be limited to such illustrative embodiments illustrating some possible non-limiting combination of features that may exist alone or in other combinations of features. In particular, while the detailed description provided herein is directed to applications related to football, the invention is not so limited. The invention can be used for any sport or activity which utilizes a dynamic mobile device to simulate player or participant's motion.

Figure 5:
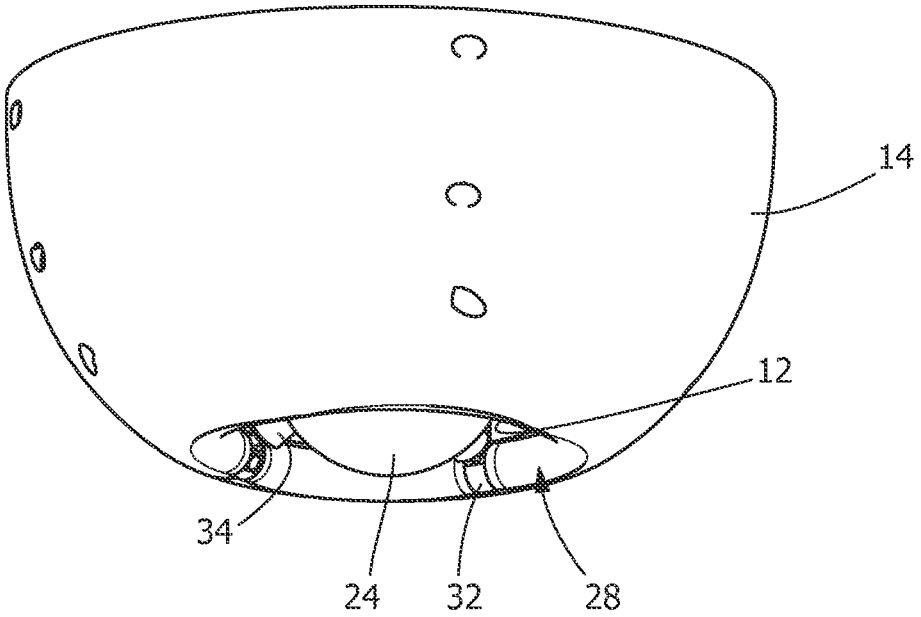
FIG. 5 is a bottom, side perspective view of a lower portion of the mobile device of FIG. 1.
Figure 6:
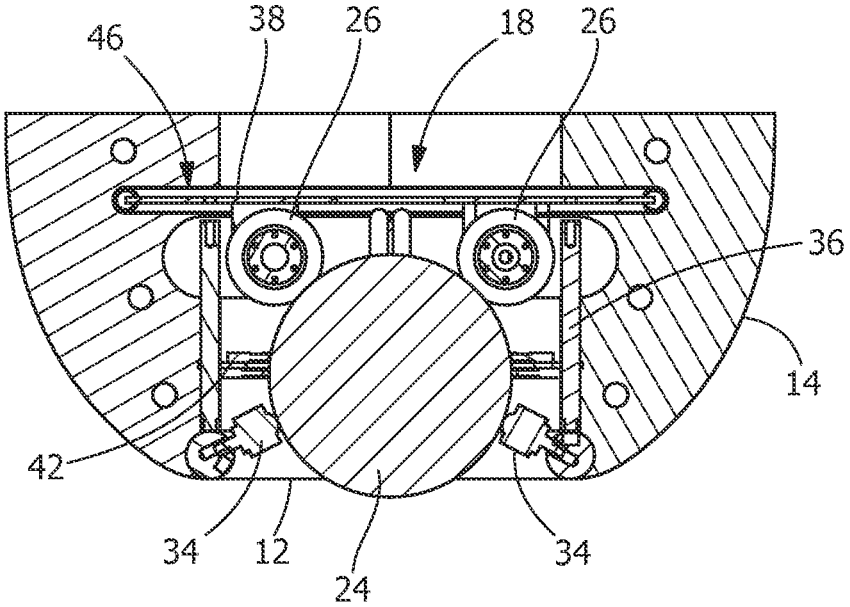
FIG. 6 is a cross section of the lower portion of the mobile device taken along line 6-6 of FIG. 5.

In general, the invention is directed to a remotely controlled, self-righting dummy or mobile device 10 and to a drive system which controls the same. As shown in the illustrative embodiment of FIG. 1, the device 10 has no external infrastructure in order to maximize mobility of the device and the safety of the players tackling it. The entire device 10, with the exception of the bottom opening 12 (FIGS. 5 and 6), is covered in padding 14, 16.

Different types of motion of the device may be used, including, but not limited to, leaning, rolling, sliding and launching. In the illustrative embodiment shown in FIGS. 1-6, rolling motion is used because it is the most similar to the motion of a live player. The rolling motion is accomplished by a ball drive system 18 that will be more fully described below. The ball drive 18, as best shown in FIGS. 2 through 4 and 6, accurately mimics the unpredictable motion of a live player by allowing instant acceleration in any direction. The ball drive 18 also does not have a large turning radius or edges that could injure a player.

In the illustrative embodiment shown, gravity is used to reset the device 10 after the device 10 is tackled to the ground. As the device 10 is self-righting, no additional motors or other devices are required for this function. In order to accomplish this method of reset, the geometry and weight distribution of the pads 14, 16 of the device 10 allows the device to be passively self-righting, allowing for the quick repetitions of drills that are required during practice.

At least one motor 20 is used as the motive force. The at least one motor is easily controllable and can provide ample force. Batteries 22 are used as the power source because they are portable and a safe power source that will work in all weather conditions. The device is controlled using a remote control system, allowing for maximum mobility and precision.

As shown in FIG. 1, the shape of the pad approximates a humanoid form figure in the illustrative embodiment. This gives players a realistic-looking target and reinforces safe tackling form by encouraging tackling at the correct height.

The device is driven by a uni-ball drive system 18, although other drive systems such as, but not limited to, multi-ball drive systems and wheel based systems may be used without departing from the scope of the invention. The uni-ball drive system 18 shown includes a single large ball 24 that is driven by wheels 26. In the embodiment, the wheels 26 are omni-directional wheels. The omni-directional wheels are able to power the ball 24 in any direction, allowing for a complete range of motion and allowing for the device to quickly and elegantly change directions.

In the illustrative embodiment, the wheels 26 have rubber rollers to increase the resistance to slipping between the ball 24 and the rollers 26. Other materials can be used to decrease the slippage of the ball relative to the rollers.

In one embodiment, dual omni-wheels 26 are used to transmit forces tangent to their direction of motion to the ball 24, while not inhibiting motion in all other directions. The omni-directional wheels may be of various sizes depending upon the size of the device and the type of ball drive used. For example, in the illustrative embodiment shown, the omni-wheels 26 may have a four inch diameter.

In the embodiment shown, a ten inch diameter medicine ball 24 with rubber coating is used as the drive ball. The ball is selected to optimize its weight, compressibility and friction coefficient with the turf to allow for optimal performance of the device 10. The ball 24 sits within a two inch outside diameter base-ring 28 made from four 90-degree mandrel bent steel elbows 30. Steel slugs 32 are welded between the elbows 30 with holes drilled and tapped for adjustable spring members 34 to secure the drive ball 24. Four vertical rods 36 connect the base ring 28 to a plate 38, on which the motors 20 and controls system are mounted. The spring members 34 are adjustable. In the embodiment shown, the spring members 34 are ball casters which are spring loaded to apply pressure to the ball 24. Consequently, the ball casters 34 apply pressure to the ball 24 to keep the wheels 26 in contact with the ball 24 at all times despite any eccentricity in the ball's 24 shape.

As an example, drive balls 24 are not spherical, exhibiting variance in the diameter of up to 3/4 inches. In such applications, the adjustability of the ball casters 34 is beneficial. Rather than fixing the ball casters 34 against the ball 24, tension springs are included in the ball casters 34 to allow the ball casters 34 to force the ball 24 toward the wheels 26, causing the omni-wheels 26 to remain in contact with the ball 24 at all times despite eccentricity in the ball's shape. Consequently, the ability of the motors 20 to drive the ball 24 in any direction is not affected by the eccentricity of the ball 24.

The ball 24 drive must have adequate traction on the field, particularly in wet conditions. Artificial turf has a higher coefficient of friction than natural grass and does not become as slippery when wet. An illustrative embodiment has a coefficient of friction with the turf of greater than 0.35, greater than 0.5 or greater than 0.7.

In one alternate embodiment, a basketball was chosen for the ball 24 drive. In other embodiments, a soccer ball, tether ball, medicine ball or water polo ball were used. Regardless of the ball 24 used, the weight of the ball 24 must be considered. A ball that is heavy relative to the overall weight of the device 10 causes ball's 24 moment of inertia relative to the device to be large, thereby causing the unwanted effect of having the pads 14, 16 rotate around the ball, rather than the ball 24 rotating within the pads 14, 16. In such an embodiment, an inflatable ball 24 acts as a suspension system to maintain constant pressure on all contact points with the wheels 26. In addition, the use of a ball 24 that deforms under pressure may result in smaller resistive forces that the motors 20 would need to overcome to drive the wheels 26 and the ball 24.

In another alternate embodiment, a non-inflatable ball 24 is used. Such a ball greatly reduces the risks associated with irregularities in ball shape, and allows for a more rigid and robust drive system. Such balls may include, but are not limited to, rubber-coated nylon and HDPE balls.

In the illustrative embodiment show, four omni-directional wheels 26 are provided to control the ball. However, other numbers, sizes, positions and types of wheels may be provided without departing from the scope of the invention. The wheels 26 are configured such that the friction of omni-wheels 26 on the ball 24 is sufficient to transmit power from the motors 20 to the drive ball 24. The four opposing omni-wheels 26 are made from aluminum with a rubber coating. In one illustrative embodiments, at least two of the omni-wheels are powered by 3 HP brushed DC motors 20 and bearings 40 on either side to prevent side-loading on the motors 20 during the impact of a tackle. The other two omni-directional wheels are free floating. A ring 42 holding brushes 44 against the equator of the ball 24 is attached to the vertical rods 36. The brushes 44 engage the ball 24 to remove debris and loose turf blades, thereby preventing the debris and turf blades from interfering with the motors 20 and wheels 26. A rubberized coating is applied to the upper plate of the upper plate 38 of frame 46 to eliminate all edges which may pose injury risks.

As mentioned previously, a 3 hp motor 20 is used in the embodiment shown. One such motor is the AmpFlow A28-150. The motor may be used with a radio transmitter 48 and receiver 50. The transmitters 48 and receivers are able to wirelessly control one motor or two or more motors independently. Another motor which can be used in the AmpFlow A28-400 motor. When used with a single 12V battery, instant acceleration in all directions is achieved with a high degree of control. When used with a 24V battery, a maximum speed of 4 m/s was achieved. Regardless of the motor used, the motor 20 must be sized to fit within the frame 46.

The speed and acceleration of the device is dependent upon many factors, including the size of the device, the type of ball drive, the size of the motor, etc. However, the device is designed to operate a minimum speed to 3 m/s and a minimum acceleration of 3 $m/s^2$, with preferred speeds of 5 m/s or greater and preferred accelerations of 7 $m/s^2$. The device is also designed to have less than a 10% loss of speed in all playable weather conditions.

The batteries 22 and battery system for the device must be of the type which are non-spillable and which are designed to be depleted and recharged many times. One such battery 22 is a lead-acid absorbed glass mat (AGM) battery. Such batteries 22 are deep cycle batteries which are designed to be completely drained and then recharged. These types of batteries 22 are non-spillable and can be used in any orientation because the electrolyte is held in glass fiber mats instead of floating freely. In one embodiment, a single 24-volt deep cycle battery can be used. Alternatively, other sizes of batteries 22 can be used, such as, but not limited to, two 12-volt batteries connected in series. An example of such a battery 22 is the MC-545 battery which weighs approximately 10 lbs and has a capacity of 14Ah. In one embodiment, full throttle for the device runs at approximately 50 amps, whereby two MC-545 batteries have the capacity to run at full throttle for around 17 minutes. Given that the device 10 will be going at full speed only a fraction of the time, this will provide sufficient capacity for the device 10 to last for a typical twenty minute tackling practice session.

The control system includes a transmitter 48, antenna, receiver 50, battery(ies) 22, speed controllers and motor(s) 20. In various embodiments, the type of motor 20 chosen dictates what type of control system could be used. In one illustrative embodiment, a radio frequency controller is used. In one illustrative embodiment, an AmpFlow Dual Motor Speed Controller is used. Such a controller can run at 24 volts and provide a 5 volt power output designed for wireless receivers. In one illustrative embodiment, a Planetary Rover Radio Control, which includes a pre-paired transmitter and receiver, can be connected directly into the speed controller. Once connected, the speed controller can be programmed for channel mixing, meaning that both motors are controlled via a single joystick. The single joystick allows the user to drive the device in any direction using an intuitive control system. The control system is designed to allow for a minimum travel distance of greater than 25 meters, with a preferred distance of greater than 100 meters, allowing the coach to operate the device from anywhere on the field.

As best shown in FIG. 1, the illustrative device 10 has high density foam 14 around the base 52 of the device 10 and lower density foam 16 for the upper portion 54 of the dummy or device 10. Foams may be open-cell foams or closed-cell foams. Open-cell foams have gas pockets which are connected to one another, creating a lower density. In contrast, closed-cell foams have isolated gas pockets for a more rigid high-density shape. The high density, closed cell foam 14 around the base 52 is used to cushion against the frame 46 and provide protection for the electronics. The high density, closed cell foam 14 also provides structure for the self-righting nature of the dummy or device 10. The low density, open-cell foam 16 for the upper portion 54 is used where the primary impact area will be.

One such representative high density foam 14 is sold under the brand of Minicell. In one embodiment, the high density foam 14 is provided in a bowl shape to encase the frame 46 and allow the device or dummy 10 to be self-righting. In one embodiment, the bowl shaped foam was constructed in two hemispheres that are connected around the frame or cage 46 via two straps. This modular design provides easy access to the electronics and drive system for maintenance, as the two halves can be swiftly disconnected and removed.

The upper portion 54 of the device 10 has a humanoid formed pad 16, although other configurations can be used without departing from the scope of the invention. The upper portion 54 is configured to encourage safe tackling at the correct contact height by reflecting the proportions of an average player in an exaggerated manner. This foam 16 must be significantly softer on impact than the base foam 14, yet rigid enough to hold its shape. While different types of foam 16 can be used, in one embodiment, a castable urethane foam is used. One such foam is the 3 $lb/ft^3$ FlexFoam-iT III foam. The shape of the upper portion can be cast in one piece or in two identical halves which are fused together. Based on player safety and other testing, the high density foam 14 has a density between 4 $lb/ft^3$ and 6 $lb/ft^3$ and the low density foam 16 has a density between 2 $lb/ft^3$ and 4 $lb/ft^3$, although other densities of the high density foam and the low density foam may be used.

In the embodiment shown, a structural element 56 is provided for supporting the upper portion of foam 16. The structural element 56 also provides a robust connection between the frame 46, the upper portion 54 and the lower portion 52. The structural element 56 is a rigid but slightly flexible cylinder or post made from high density polyurethane. However, in other embodiments, other materials such as a steel beam or pipe may be used for the structural element 56. This material is highly durable, able to sustain a high force impact and is designed to restore itself to vertical after bending. The structural element 56 is bolted to the frame 46 of the device or dummy 10 and the two halves of the upper portion 54 are affixed thereto by glue or other known fasteners. However, other known methods of fastening the structural element 56 to the frame 46 and the upper portion 54 can be used without departing from the scope of the invention.

The foam 14, 16 may be painted and/or the foam may be coated in shrink film or other durable coating to provide a durable, uniform and aesthetically pleasing finish.

The device 10 is configured to be tall enough and heavy enough to provide a realistic visual target and realistic tackling resistance for players. In one embodiment, the device 10 has a weight of approximately 188 lbs and a height of approximately 63 inches.

In order for football practices to run efficiently, the device or dummy 10 must be able to be reset quickly between repetitions of a drill. This time was quantified as 4 seconds, based upon calculations from observing football practice. As previously described, the device 10 is constructed to have a weight distribution such that it is passively self-righting. Therefore, depending upon the weight of the components and foam 14, 16 used, additional weight may be added to the bottom portion to ensure that the device 10 is self-righted in 2 second, 3 seconds, 4 seconds or less than 5 seconds. In order to mitigate improper stabilization resulting in wobble when driving, weights may be added to the frame 46, which will stabilize the device or dummy 10 and assist in self-righting. Widening the contact area with the field will also increase the device's 10 stability. Wobbling could also be mitigated by designing a suspension system that produces a restorative force for the device or dummy 10.

The mobile device 10 and system simulates player motion as realistically as possible in order to practice various movements. In particular, the mobile device 10 and system allows for practice of various movements, such as tackling, with no need for person-to-person contact. The ball drive 24 and wheels 26 permit for motion of the device 10 in any direction along a field, thereby allowing players to practice proper tackling form in a simulated game-relevant scenario. The mobile device 10 and system provide a safe alternative to live play and will increase player safety and reduce the incidence of injuries while at the same time reinforcing proper form.

While the invention has been described with reference to an illustrative embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. As an example, the use of the mobile device on artificial surfaces may cause various of the components to be altered to prevent the rubber granules from interfering with the operation of the mobile device. The presently disclosed embodiments are therefore to be considered in all respects as illustrative and not restrictive.

The invention claimed is:

1. A mobile device which simulates player motion, the device comprising:

a ball drive for providing rolling motion to the device, the ball drive being secured in a base of the mobile device by adjustable spring members which apply pressure to the ball drive;

omni-directional members positioned proximate to and in engagement with the ball drive;

at least one motor connected to at least one of the omni-directional members, the at least one motor providing the motive force to drive the at least one omni-directional member and the ball drive, the ball drive maintaining constant pressure on contact points between the ball drive and the at least one omni-directional member;

a controller which controls the at least one motor;

pads positioned on the device;

wherein, the device accurately mimics the unpredictable motion of a live player to provide a safer alternative to live play to increase player safety and decrease the incidence of injuries during practice sessions.

2. The mobile device of claim 1, wherein the pads approximate a humanoid form figure.

3. The mobile device of claim 1, wherein the ball drive includes a single ball that is driven by the at least one omni-directional member, the at least one omni-member engage the ball to power the ball in any direction, allowing for the mobile device to have a complete range of motion and allowing the mobile device to quickly change directions.

4. The mobile device of claim 3, wherein the ball has a rubber coating.

5. The mobile device of claim 3, wherein adjustable ball casters cooperate with the ball drive, the ball casters apply pressure to the ball to keep the omni-members in contact with the ball at all times despite any eccentricity in the ball's shape.

6. The mobile device of claim 5, wherein four ball casters are provided.

7. The mobile device of claim 1, wherein four omni-directional members are provided, at least two of the four omni-directional members having a motor of the at least one motors which controls the respective omni-directional wheel.

8. The mobile device of claim 1, wherein the omni-directional members are rubber coated to increase the slipping resistance between the ball drive and the omni-directional members.

9. The mobile device of claim 1, wherein the at least one motor has bearings on either side to prevent side-loading on the at least one motor during use of the mobile device.

10. The mobile device of claim 1, wherein deep cycle batteries are provided to power the at least one motor.

11. The mobile device of claim 1, wherein the controller is a wireless controller which is part of a control system which controls the at least one motor.

12. The mobile device of claim 1, wherein the pads include high density foam around a base of the mobile device, the high density provides structure to self-right the mobile device.

13. The mobile device of claim 1, wherein the pads include low density foam in an upper portion of the mobile device used as the primary impact area.

14. The mobile device of claim 13, wherein a structural beam is provided to support the foam in the upper portion of the mobile device.

15. The mobile device of claim 13, wherein the pads are coated in shrink film or other durable coating to provide a durable finish.

16. A self-righting mobile device which simulates player motion, the device comprising:

a ball drive for providing rolling motion to the device, the ball drive being secured in a base of the mobile device by adjustable spring members which apply pressure to the ball drive;

omni-directional wheels positioned proximate to and in engagement with the ball drive;

at least one motor connected to at least one of the omni-directional wheels, the at least one motor providing the motive force to drive the at least one omni-directional wheel and the ball drive;

a controller which controls the at least one motor;

pads positioned on the device, the pads include high density foam around a base of the mobile device, the high density providing structure to self-right the mobile device, the pads include low density foam in an upper portion of the mobile device used as the primary impact area, the geometry and weight distribution of the pads cause the mobile device to be self-righting in no more than 5 seconds;

wherein the device accurately mimics the unpredictable motion of a live player to provide a safer alternative to live play to increase player safety and decrease the incidence of injuries during practice sessions.

17. The mobile device of claim 16, wherein the high density foam has a density of between 4 $lb/ft^3$ and 6 $lb/ft^3$.

18. The mobile device of claim 16, wherein the low density foam has a density between2 $lb/ft^3$ and 4 $lb/ft^3$.

19. The mobile device of claim 16, wherein the pads approximate a humanoid form figure.

20. A mobile device which simulates player motion, the device comprising:

a ball drive for providing rolling motion to the device;

omni-directional wheels positioned proximate to and in engagement with the ball drive, at least one of the omni-wheels engage the ball drive to power the ball drive in any direction, allowing for the mobile device to have a complete range of motion and allowing the mobile device to quickly change directions;

at least one motor connected to the at least one omni-directional wheel, the at least one motor providing the motive force to drive the omni-directional wheels and the ball drive;

adjustable casters spaced from the omni-directional wheels, the adjustable casters cooperating with the ball drive, the casters having tension springs which force the ball into contact with the omni-directional wheels to keep the omni-wheels in contact with the ball drive at all times despite any eccentricity in the shape of the ball drive;

a controller which controls the at least one motor;

pads positioned on the device;

wherein, the device accurately mimics the unpredictable motion of a live player to provide a safer alternative to live play to increase player safety and decrease the incidence of injuries during practice sessions.

21. A drive system for a mobile device, the drive system comprising:

a ball drive for providing rolling motion to the mobile device;

omni-directional members positioned proximate to and in engagement with the ball drive;

at least one motor connected to at least one of the omni-directional members, the at least one motor providing the motive force to drive the at least one omni-directional member and the ball drive;

adjustable casters spaced from the omni-directional wheels, the adjustable casters cooperating with the ball drive, the casters having tension springs which force the ball into contact with the omni-directional wheels to keep the omni-wheels in contact with the ball drive at all times despite any eccentricity in the shape of the ball drive;

a controller which controls the at least one motor.

* * * * *